US011565311B2

(12) United States Patent
Collura et al.

(10) Patent No.: US 11,565,311 B2
(45) Date of Patent: Jan. 31, 2023

(54) SLIDING GATE VALVE PLATE

(71) Applicant: VESUVIUS GROUP, SA, Ghlin (BE)

(72) Inventors: Mariano Collura, Strepy-Bracquegnies (BE); Fabrice Sibiet, Colleret (FR)

(73) Assignee: Vesuvius Group, S.A., Ghlin (BE)

( * ) Notice: Subject to any disclaimer, the term of this patent is extended or adjusted under 35 U.S.C. 154(b) by 1099 days.

(21) Appl. No.: 16/070,453

(22) PCT Filed: Jan. 24, 2017

(86) PCT No.: PCT/EP2017/051428

§ 371 (c)(1),
(2) Date: Jul. 16, 2018

(87) PCT Pub. No.: WO2017/129563

PCT Pub. Date: Aug. 3, 2017

(65) Prior Publication Data

US 2019/0022747 A1 Jan. 24, 2019

(30) Foreign Application Priority Data

Jan. 25, 2016 (EP) ..... 16152591

(51) Int. Cl.

| | |
|---|---|
| ***B22D 41/28*** | (2006.01) |
| ***B22D 41/22*** | (2006.01) |
| ***B22D 41/34*** | (2006.01) |
| ***B22D 41/40*** | (2006.01) |

(52) U.S. Cl.

CPC ..... *B22D 41/34* (2013.01); *B22D 41/22* (2013.01); *B22D 41/28* (2013.01); *B22D 41/40* (2013.01)

(58) Field of Classification Search

CPC ..... B22D 41/22; B22D 41/28; B22D 41/34; B22D 41/40

See application file for complete search history.

(56) References Cited

U.S. PATENT DOCUMENTS

| | | | |
|---|---|---|---|
| 311,902 | A | 2/1885 | Lewis |
| 506,328 | A | 10/1893 | Morris |
| 5,011,050 | A | 4/1991 | Verel |

(Continued)

FOREIGN PATENT DOCUMENTS

| | | | |
|---|---|---|---|
| CN | 1747803 | A | 3/2006 |
| CN | 201333520 | Y | 10/2009 |

(Continued)

*Primary Examiner* — Kevin E Yoon
(74) *Attorney, Agent, or Firm* — Blue Filament Law PLLC

(57) ABSTRACT

A refractory sliding gate valve plate has a planar upper surface and a planar lower surface parallel to the planar upper surface. A connecting outer surface connects the upper surface to the lower surface, and a pouring channel fluidly connects the upper surface to the lower surface. Specified ratios of length between (a) specified longitudinal segments extending from the axis of symmetry of the pouring channel to the perimeter on the upper surface and the lower surface of the plate, respectively, and also between (b) specified latitudinal segments extending from the axis of symmetry of the pouring channel to the perimeter on the upper surface and the lower surface of the plate, respectively, increase the uniformity of thrust force applied to the plates and the contact area between the upper surfaces of two such plates within a valve.

15 Claims, 4 Drawing Sheets

(56) References Cited

U.S. PATENT DOCUMENTS

| | | | | |
|---|---|---|---|---|
| 5,100,034 | A | 3/1992 | Russo | |
| 5,251,794 | A | 10/1993 | Toaldo | |
| 5,518,154 | A | 5/1996 | Vassilicos et al. | |
| 5,893,492 | A | 4/1999 | Hanse et al. | |
| 6,382,477 | B1 | 5/2002 | Yamamoto et al. | |
| 6,415,967 | B1 | 7/2002 | Toaldo | |
| 6,814,268 | B2 | 11/2004 | Rothfuss et al. | |
| 7,290,685 | B2 * | 11/2007 | Yotabun ..... | B22D 41/28 266/236 |
| 8,740,024 | B2 | 6/2014 | Steiner et al. | |
| 2002/0175452 | A1 | 11/2002 | Kawarada | |
| 2006/0118268 | A1 | 6/2006 | Collura et al. | |
| 2015/0246392 | A1 | 9/2015 | Gisler et al. | |

FOREIGN PATENT DOCUMENTS

| | | | |
|---|---|---|---|
| CN | 102006952 | A | 4/2011 |
| DE | 19630171 | A1 | 1/1998 |
| EP | 1029618 | A1 | 8/2000 |
| EP | 1716944 | A1 | 11/2006 |
| JP | H10509650 | | 9/1998 |
| JP | 2006508804 | A | 3/2006 |
| JP | 2007069214 | A | 3/2007 |
| KR | 20090118475 | A | 11/2009 |
| TW | 418141 | B | 1/2001 |
| TW | 542758 | B | 7/2003 |
| TW | 555944 | B | 10/2003 |
| WO | 02070173 | A1 | 9/2002 |
| WO | 2002070173 | A1 | 9/2002 |
| WO | 2004052575 | A1 | 6/2004 |

* cited by examiner

SLIDING GATE VALVE PLATE

CROSS-REFERENCE TO RELATED APPLICATIONS

This application is a U.S. national stage application, filed under 35 U.S.C. § 371, of International Application No. PCT/EP2017/051428, which was filed on Jan. 24, 2017, and which claims priority from European Patent Application No. EP16152591.0, which was filed on Jan. 25, 2016, the contents of each of which are incorporated by reference into this specification.

FIELD OF THE INVENTION

The present invention relates to a refractory sliding gate valve plate for a molten metal sliding gate valve. In the casting of molten metal, sliding gate valves are used to control the flow of molten metal poured from an upstream metallurgical vessel to a downstream vessel, for example, from a furnace to a ladle, from a ladle to a tundish or from a tundish into an ingot mold. Sliding gate valves comprise at least two refractory sliding gate valve plates that slide with respect to each other. The sliding movement of the plates can be linear (wherein the sliding gate valve is moved in a linear direction) or rotary (wherein one plate is rotated with respect to the other). In the following description, reference will be made to the continuous casting of molten steel but it is to be understood that the present invention can be used for sliding gate used for the regulation of a stream of any molten material wherein refractory sliding gate valve plates are used (glass, metal, etc.).

BACKGROUND OF THE INVENTION

Sliding gate valves have been known since 1883. For example U.S. Pat. Nos. 0,311,902 or 0,506,328 disclose sliding gate valves arranged under the bottom of a casting ladle wherein pairs of refractory sliding gate valve plates provided with a pouring orifice are slid one with respect to the other. When the pouring orifices are in register or partially overlap, molten metal can flow through the sliding gate valve. When there is no overlap between the pouring orifices, the molten metal flow is totally stopped. Partial overlap of the pouring orifices allows the regulation of the molten metal flow by throttling the molten metal stream. The first sliding gate valve plates have been used at an industrial scale in Germany at the end of the 1960's. The technology has significantly improved over the years and is now widely used.

Since the first age of the sliding gate valves, attention has been paid to security of the operators and of the installation, air tightness, cracking of the sliding gate valve plates, erosion of the plates, etc. Reference can be made, for example to U.S. Pat. No. 5,893,492 proposing to use both faces of a plate and a security concept preventing insertion of a plate in a housing of the sliding gate valve in a wrong orientation or to U.S. Pat. No. 6,814,268 B2 proposing a solution to reduce the initiation of cracks in a sliding gate valve plate and to prevent the propagation of cracks if any are formed.

Despite considerable progresses observed since the first sliding gate valves, there is still room for improvement. In particular, the present inventors have observed that with existing sliding gate valve plates, it can happen that refractory plates bend or warp during use. It is supposed that this phenomenon is due to the thermal stresses caused by the huge gradient of temperature existing in the plate (the area close to the pouring orifice is raised to a temperature above 1500° C. by the molten steel passing through the pouring orifice while the plate periphery which is only a few centimeters away is at a temperature of around 300-400° C.) combined with mechanical stresses caused by inhomogeneous thrust forces applied to maintain the plates in tight contact. In turn, this bending or warping of the plates can decrease the effective contact area between two plates to value as low as 38%. In the sense of the present invention, the effective contact area is the ratio (expressed in %) of the actual contact area between the plates to the theoretical contact area between two plates assuming that the contact is perfect, in both cases when the two plates are in perfect registry. The actual and theoretical contact areas can be computed by finite element analysis.

Such a low effective contact area is not compatible with a sufficient air tightness and can be responsible for air ingress through the joint between plates into the molten steel poured through the plates. Air ingress is detrimental to the quality of the poured molten steel and to the life expectancy of the refractory plates. In particular, air oxidizes the carbon material used to bond the refractory elements of the plates. Solutions have been developed in the prior art to limit the effect of air ingress such as for example the addition of oxygen scavengers (aluminum, calcium, silicon, etc.) into the molten steel bath to react with oxygen. In turn, the reaction products of these scavengers with oxygen can create further issues downstream the sliding gate valve (clogging due to alumina deposit). It has also been proposed to protect the pouring orifice with an inert gas (argon for example) that is either circulated in a groove at the joint between the plates or in a tight box surrounding the whole sliding gate valve. Beyond the impractical aspects of these solutions, inert gases are expensive and dangerous for the operators.

On top of the air ingress issues, low effective contact area between plates can also cause finning episodes wherein a small film (called a "fin") of molten metal penetrates the joint between two plates. Upon solidification, the metal fin scraps the surfaces of the two plates and seriously damages their contact surface. Moreover, the metal fins act as a wedge spreading the plates favoring further finning episodes eventually resulting in a molten steel leakage.

The present inventors are not aware of any attempt in the prior art to cope with these issues by modifying the plate geometry.

Moreover, the inventors have also highlighted that, due to this uneven application of the thrust force to the plates, extremely high peaks of pressure (as high as 12 MPa) could be observed locally. Such high peaks of pressure cause abrasion and dramatically reduce the life expectancy of the refractory plates.

The aim of the present invention is to remedy simultaneously to these problems (increasing security of the operators and installation, improving the steel quality, extending the life of the refractory plates) while keeping the operating conditions relatively similar to the current conditions (weight of the plates, manual work, etc.).

SUMMARY OF THE INVENTION

The objectives of the present invention have been reached with a refractory sliding gate valve plate for a molten metal gate valve having:

an upper surface, a lower surface, separated from the upper surface by a thickness of the sliding gate valve plate, said upper and lower surfaces being planar and parallel to one another, a connecting outer surface connecting the upper surface to the lower surface and a pouring channel fluidly connecting the upper surface (2) to the lower surface (3), said pouring channel having a pouring axis of symmetry (Xp), the upper and lower surfaces having upper and lower longitudinal extents (LOu, LOl), respectively, which are parallel to each other and, perpendicular to the upper and lower longitudinal extents (LOu, LOl), having upper and lower latitudinal extents (LAu, LAl), respectively, wherein the upper longitudinal extent (LOu) is the longest segment connecting two points of a perimeter of the upper surface and intersecting the pouring axis of symmetry (Xp), the longitudinal extents (LOu, LOl) being divided into two segments (respectively LOu1 and LOu2 and LOl1 and LOl2) connecting at the level of the pouring axis of symmetry (Xp), and wherein the segments LOu1 and LOl1 are on a first side of the pouring axis of symmetry, and the segments LOu2 and LOl2 are on a second side of the pouring axis of symmetry;

the latitudinal extents (LAu, LAl) being divided into two segments (respectively LAu1 and LAu2 and LAl1 and LAl2) connecting at the level of the pouring axis of symmetry (Xp), and wherein the segments LAu1 and LAl1 are on a first side of the pouring axis of symmetry, and the segments LAu2 and LAl2 are on a second side of the pouring axis of symmetry;

wherein the following ratios are defined as:

R1=LOl1/LOu1, having a value from and including 50% to and including 95%, from and including 57% to and including 92%, or from and including 62.5% to and including 90%, R2=LOl2/LOu2, having a value from and including 50% to and including 95%, between 57 and 92%, or from and including 62.5 to and including 90%, R3=LAl1/LAu1, greater than or equal to 75%, greater than or equal to 90%, or greater than or equal to 95%, R4=LAl2/LAu2, greater than or equal to 75%, greater than or equal to 90%, or greater than or equal to 95%.

In the sense of the present invention, a refractory sliding gate valve plate is to be understood as the plate as inserted into a sliding gate valve, including a "naked" refractory plate, a canned plate (i.e. the combination of a refractory body, mortar or cement and a metal envelope surrounding the periphery and a part of a surface) or a banded plate (i.e. the combination of a refractory plate and a belt surrounding the refractory plate). In the case of a canned or banded plate, the upper surface is defined as the refractory planar surface protruding out of the can/band. In case of a canned plate, the lower surface is defined as the planar surface of the can surrounding the pouring channel.

In the sense of the present invention, a pouring axis of symmetry, Xp, of the pouring channel is the axis having highest degree of symmetry of the channel geometry. For example, in a cylindrical pouring channel, the axis of symmetry, Xp, is the axis of revolution of the cylindrical channel. In case of a channel having an elliptical cross-section, the pouring axis of symmetry is the axis passing through the intersection of the large and small diameters of the elliptical cross-section of the channel. In more general terms, in the unlikely case of a pouring channel having no symmetry at all, the pouring axis of symmetry, Xp, is the axis normal to the upper surface and passing through the centroid of the channel cross-section at the level of the upper surface. This definition applies to any pouring channel geometry, even geometries showing high levels of symmetries such as a cylindrical pouring channel. The pouring axis of symmetry of a plate, Xp, corresponds to the pouring axis of symmetry of the adjacent refractory element of the casting installation (i.e., the inner nozzle or the collector nozzle).

In the sense of the present invention, the upper surface is defined as "the largest planar surface defined by a closed line forming a perimeter of said planar surface, and comprising a pouring channel opening". In a sliding gate valve, the upper surface of a first sliding gate valve plate contacts and slides along the upper surface of a second, generally albeit not necessarily, identical sliding gate valve plate. Of course, for defining the upper longitudinal and latitudinal extents and their respective lengths, the pouring channel inlet is ignored.

The lower surface is defined as the "second largest planar surface defined by a closed line forming a perimeter of said planar surface, and comprising a pouring channel opening." All the points of that surface are comprised in a plane that is parallel to the plane of the upper surface. In use in a sliding gate valve comprising a second sliding gate valve plate held in fixed position, the lower surface of a first sliding gate valve plate is the surface of contact between said first sliding gate valve plate and the pushing means of a dynamic receiving station of the frame holding the sliding gate valve plates in sliding contact as well as the sliding mechanism controlling the relative position of the pouring channels of the first and second sliding gate valve plates, and thus the opening of the sliding gate valve. Of course, for defining the lower longitudinal and latitudinal extents and their respective lengths, the pouring channel inlet is ignored. Similarly, in canned plates (i.e., plates dressed with a metal can), the opening around the pouring orifice for receiving a collector nozzle or an inner nozzle and also cuts for reducing weight or for assisting in clamping the plate (as disclosed U.S. Pat. No. 6,415,967B1) are ignored too.

In the sense of the present invention, the longitudinal extent of a surface is defined as the longest segment joining two points of the perimeter of that surface intersecting the pouring axis of symmetry, Xp, while the latitudinal extents are the extents of the plate in the same plane in a direction perpendicular to the longitudinal extents and intersecting the pouring axis of symmetry, Xp.

The longitudinal extents of each of the upper and lower surfaces are divided into two segments, (LOu1 and LOu2) and (LOl1 and LOl2), respectively, each extending from one point of the perimeter of the corresponding surface to the pouring axis of symmetry, Xp. Similarly, the latitudinal extents of each of the upper and lower surfaces are divided into two segments, (LAu1 and LAu2) and (LAl1 and LAl2), respectively, each extending from one point of the perimeter of the corresponding surface to the pouring axis of symmetry, Xp. By convention LOu1 and LAu1, are the longest segments of a corresponding longitudinal and latitudinal extents while LOu2, LAu2 are the shortest segments thereof. The segments LOl1&2 and LAl1&2 in the lower surface are numbered in the same order as in the upper surface. If the two segments of a given extent of the upper surface are of the same length, then it is the longest segment of the corresponding lower extent of the lower surface which determines which segments of the upper and lower surfaces are labelled "1". If the corresponding lower extent is also divided in two segments of the same length, than the numbering 1 or 2 can be assigned freely, provided that they are used in the same order in the upper and lower surfaces.

The perimeters of both upper and lower surfaces are closed and may comprise no changes in concavity with portions thereof passing from forming a convex curve to forming a concave curve. The perimeter may be smooth with no singular point with a discontinuity in the tangent. In case a portion of the actual perimeter defining a planar surface comprised a singular recess or protrusion forming a recessing or jutting tongue of the planar surface, the longitudinal and latitudinal extents are determined ignoring said singular protrusion or recess and a theoretical perimeter is considered instead by joining with a straight line the two boundary points of the actual perimeter forming the boundaries of said singular recess or protrusion (cf. FIG. 2(*b*)). The boundary points are defined as the points where a singularity occurs, either a change in the sign of the curvature or a discontinuity in the tangent to the curve. A theoretical perimeter is to be considered for the determination of the longitudinal and latitudinal extents instead of the actual perimeter in all cases wherein the two boundary points are separated from one another by a distance of less than 10% of the length of the total theoretical perimeter.

The present invention also relates to a metal can for dressing a refractory element and therewith forming a sliding gate valve plate as described supra. The combination of the metal can and a refractory element may comprise a sliding gate valve plate as described above. The metal can comprises:

a bottom surface defined by a perimeter, and comprising an opening having a centroid point (xp), such that the pouring axis of symmetry (Xp) is the axis normal to the bottom surface and passing through the centroid point (xp);

a peripheral surface extending transverse to the bottom surface from the perimeter of said bottom surface to a free end defining a rim of the metal can, said peripheral surface and bottom surface defining an inner cavity of geometry fitting the geometry of a refractory element to be adhered to the metal can by means of a cement, and wherein:

the metal can has an upper longitudinal diameter (LCu) defined as the longest segment connecting two points of the rim of the metal can and intersecting the pouring axis of symmetry (Xp), and has an upper latitudinal diameter (LDu) connecting two points of the rim of the metal can, and intersecting perpendicularly the upper longitudinal diameter (LCu) and the pouring axis of symmetry (Xp), the bottom surface has a lower longitudinal diameter (LCl), which is parallel to the upper longitudinal diameter (LCu) and has a lower latitudinal diameter (LDl), which is parallel to the lower longitudinal diameter (LDu), both lower longitudinal and latitudinal diameters intersecting the pouring axis of symmetry at the centroid point (xp);

the upper and lower longitudinal diameters (LCu, LCl) being divided into two segments (respectively LCu1 and LCu2 and LCl1 and LCl2) connecting at the level of the pouring axis (Xp), and wherein the segments LCu1 and LCl1 are on a first side of the pouring axis of symmetry, and the segments LOu2 and LOl2 are on a second side of the pouring axis of symmetry;

the upper and lower latitudinal diameters (LDu, LDl) being divided into two segments (respectively LDu1 and LDu2 and LDl1 and LDl2) connecting at the level of the pouring axis of symmetry (Xp),), and wherein the segments LAu1 and LAl1 are on a first side of the pouring axis of symmetry, and the segments LDu2 and LDl2 are on a second side of the pouring axis of symmetry;

wherein the following ratios are defined

Rc1=LCl1/LCu1, having a value from and including 50% to and including 95%, or from and including 57% to and including 92%, or from and including 62.5% to and including 90%, Rc2=LCl2/LCu2, having a value from and including 50 to and including 95%, or from and including 57% to and including 92%, or from and including 62.5% to and including 90%, Rc3=LDl1/LDu1, is greater than or equal to 75%, or greater than or equal to 90%, or greater than or equal to 95%, Rc4=LDl2/LDu2, is greater than or equal to 75%, or greater than or equal to 90%, or greater than or equal to 95%.

When a metal can is used, it forms the lower surface of a first sliding gate plate. When mounted in a sliding gate valve frame, forces are applied onto the bottom surface of the metal can to press the upper surface of said first sliding gate valve plate against the upper surface of a second sliding gate valve gate plate mounted statically in said frame.

The present invention also concerns a sliding gate valve comprising a set of first and second sliding gate valve plates mounted in a frame, wherein, the first sliding gate valve plate is as described supra and comprises an upper surface which is planar and has an upper area, AU, delimited by a perimeter enclosing an inlet of a pouring channel, and comprises a lower surface, which is planar and has a lower area, AL, delimited by a perimeter enclosing an outlet of the pouring channel (5L), the planar upper and lower surfaces of the first sliding gate valve plate being parallel with one another, the second sliding gate valve plate comprises a planar upper surface which is planar and has an upper area, AU, delimited by a perimeter enclosing an outlet of a pouring channel and of same geometry as the upper surface of the first sliding gate valve plate, and comprises a lower surface, which is planar and is delimited by a perimeter enclosing an inlet of the pouring channel, the planar upper and lower surfaces of the second sliding gate valve plate being parallel with one another, wherein said first and second sliding valve gate plates are mounted in a frame with their respective upper surfaces contacting and parallel to each other such that, the second sliding gate valve plate is fixedly mounted in the frame, the first sliding gate valve plate can reversibly move along a plane parallel to the upper surfaces of the first and second sliding valve plates from a pouring position wherein the pouring channel of the first sliding valve gate plate is in registry with the pouring channel (5L) of the second sliding valve gate plate, to a closed position, wherein the pouring channel of the first sliding valve gate plate is not in fluid communication with the pouring channel of the second sliding valve gate plate, said sliding gate valve further comprising several pusher units distributed about, and applying a pushing force onto the lower surface of the first sliding gate valve plate oriented normal to said lower surface of the first sliding gate valve plate, to press the upper surface of the first sliding gate valve plate against the upper surface of the second sliding gate valve plate, wherein the ratio, AL/AU, of the area, AL, of the lower surface to the area, AU, of the upper surface has a value from and including 40% to and including 85%, wherein the upper and lower areas (AU, AL) are measured ignoring the pouring channel.

According to another of its aspects, the invention relates to a sliding gate valve designed so that the thrust force communicated by the sliding gate valve to a sliding gate valve plate used in that sliding gate valve is concentrated around the pouring orifice. I.e., more than 55%, or more than 60% the surface of the plate (thus the lower surface) receiving the thrust force is located at a distance from the pouring axis of symmetry Xp lower than or equal to LaL1.

In a particular configuration, the second sliding gate valve plate is also as defined supra. In a particular configuration, the first sliding gate valve plate is identical to the second sliding gate valve plate.

In a particular configuration, the first sliding gate valve plate is supported by a carriage mounted on a sliding mechanism, such that the upper surface of the first sliding gate valve plate can slide between the pouring position and the closed position. The carriage comprises a lower surface. Pusher units apply a pushing force (F) onto the lower surface of the carriage, so as to press the upper surface of the first sliding gate valve plate against the upper surface of the second sliding gate valve plate, wherein said force (F) is oriented normal to the lower surface of the carriage.

In a configuration incorporating a carriage, the carriage comprises an upper surface which may be parallel to and recessed from the upper surface of the first sliding gate valve plate. The lower surface is permanently in contact with at least some of the pusher units, and may have a geometry such that a pusher unit contacts the lower surface of the carriage only in the case that the projection on a longitudinal plane (XpL, LOu) defined by the pouring axis of symmetry (XpL) and the upper longitudinal extent (LOu) of the first sliding valve plate (1L) of the force vector defining the force (F) applied by said pusher unit when in contact with the lower surface intersects the projection on said longitudinal plane of the first sliding gate valve plate, said geometry in certain configurations comprising chamfered portions. In particular configurations, the projection of the force vector on the longitudinal plane intersects the projection on said longitudinal plane of the second sliding gate valve plate as well.

The present invention also relates to a frame of a sliding gate valve designed for receiving a first and a second sliding gate valve plate, wherein at least the first sliding gate valve plate is as defined supra, and can be moved so that its upper surface slides along the upper surface of the second sliding gate valve plate.

As is shown in the accompanying tables, the effective contact area has been increased significantly (from 38% for prior art plates to more than 65% according to the invention) and the maximum peak of pressure has been reduced by up to 50% with respect to prior art plates.

Those parameters can be further improved when R3=R4. In that case, the contact is more symmetrical and unbalance in the distribution of stresses is avoided. Furthermore, since an asymmetry of the upper surfaces with respect to the longitudinal extent does not seem to bring any particular advantages, a symmetrical design with respect to the longitudinal axis has the advantage of saving refractory material, since an optimized design on one half side of the upper surface on one side of the longitudinal extent can be applied mirror-like to the other half of the upper surface, without having to add any refractory material.

Enhanced values of effective contact area have been measured with a pair of refractory sliding gate valve plates wherein R1 and R2 are 80%±5%, or wherein R1 and R2 have values from and including 75% to and including 85%.

Favorable properties have also been measured with a refractory sliding gate valve according to the present invention, wherein R3 and R4 have values from and including 98% to and including 100%. Favorable results are also obtained when R1 and R2 are 80%±5% or wherein R3 and R4 have values from and including 75% to and including 85%, and wherein R3 and R4 have values from and including 98% to and including 100%.

The outer connecting surface can have any possible shape. For example, it can be a pseudo-conical surface, it can have a cylindrical portion, it can be in the form of a spindle or of a reverse spindle and it can be a single surface or a combination of all these shapes. The outer connecting surface can also have a shape varying around a perimeter of the sliding gate valve plate. Advantageously, the outer surface comprises a plurality of surface portions. In particular, the connecting outer surface can comprise at least a cylindrical surface portion and at least one transition surface portion. A transition surface portion is defined as a surface reducing the plate surface cross-section on a plane parallel to the upper and lower surfaces. The cylindrical surface allows to circle or band the plate with a material (for example a metal band or belt) maintaining the refractory material in compression during the casting operation. In the case in which cracks would appear, the compression forces would keep these closed and avoid propagating them. In that case, it is more favorable that the cylindrical surface connects the upper surface to the transition surface and the transition surface connects the cylindrical surface to the lower surface. The transition surface does not need to be unique and can be comprised of a plurality of transition surfaces.

In particular configurations, the sliding gate valve plate according to the invention comprises a refractory element with an upper surface and a pouring channel corresponding respectively to the upper surface and pouring channel of the plate, a metal can with a lower surface and a pouring channel corresponding respectively to the lower surface and pouring channel of the plate and cement binding the plate to the can.

In order to enable a better understanding of the invention, it will now be described with reference to the figures illustrating particular embodiments of the invention, without however limiting the invention in any way.

BRIEF DESCRIPTION OF THE DRAWINGS

Various features and characteristics of the invention described in this specification may be more thoroughly understood by reference to the accompanying figures, in which.

FIG. 7B is a three-dimensional isometric view of a metal can suitable for dressing a plate according to FIGS. 2 and 3;

DETAILED DESCRIPTION OF THE INVENTION

Figure 1:
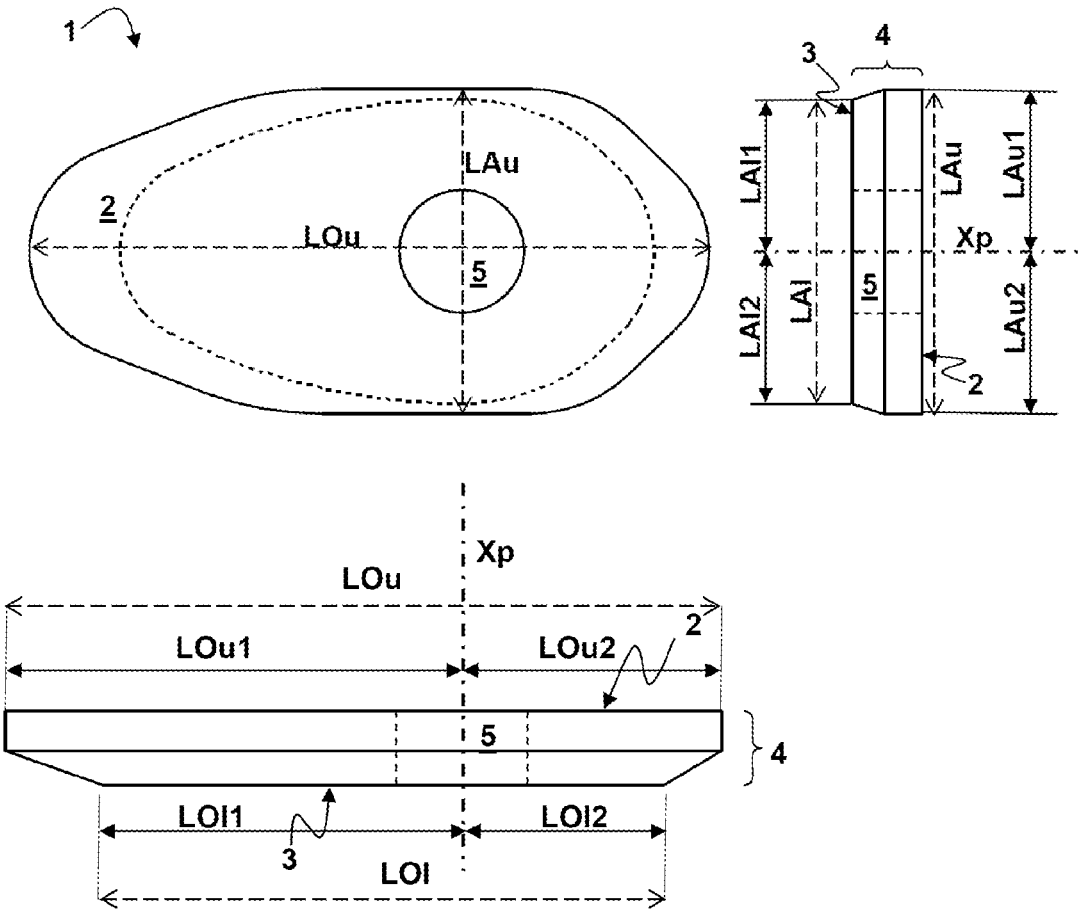
FIG. 1 depicts a plate according to an embodiment of the invention represented in top view, side and front elevation views.
Figure 2A:
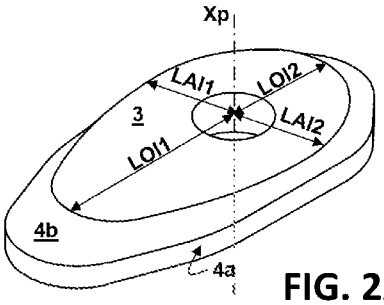
FIG. 2A is an isometric view of a plate according to FIG. 1.
Figure 3:
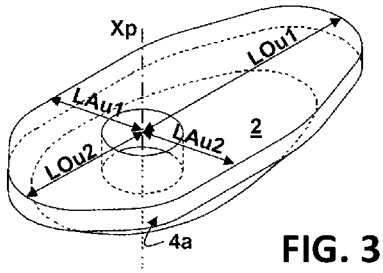
FIG. 3 is an isometric view of a plate according to FIG. 1.
Figure 2B:
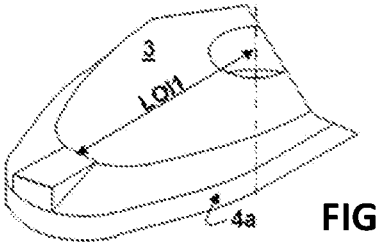
FIG. 2B is an isometric view of a portion of a plate according to FIG. 1.
Figure 4:
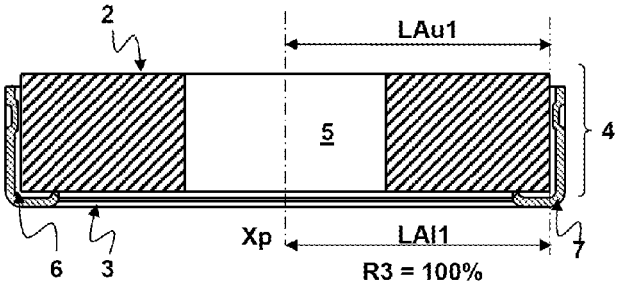
FIG. 4 is a view of a transverse section of a plate having certain R3 and R4 values.
Figure 5:
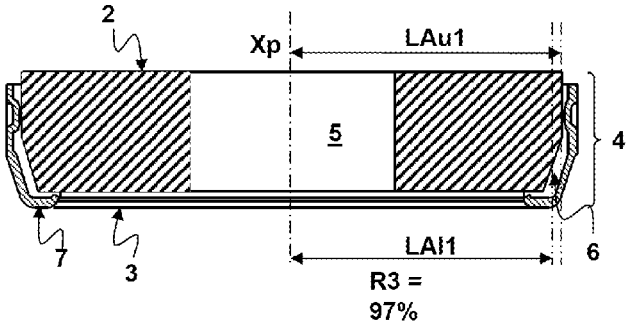
FIG. 5 is a view of a transverse section of a plate having certain R3 and R4 values.
Figure 6A:
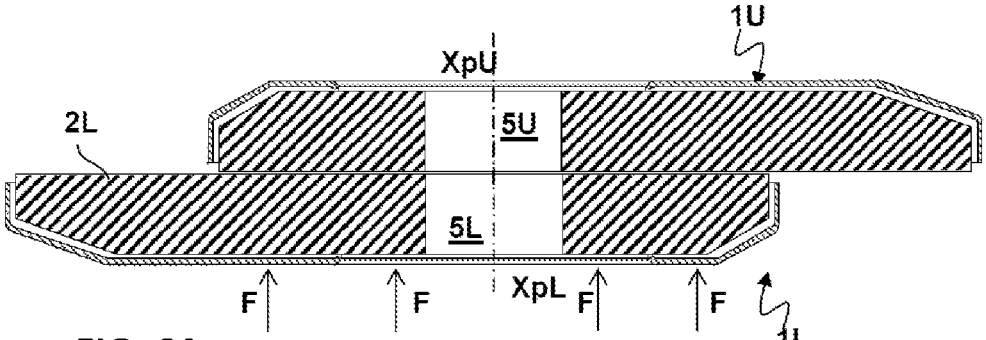
FIG. 6A is a longitudinal section of two plates positioned with their respective upper surfaces in sliding contact, with their respective pouring axes aligned.
Figure 6B:
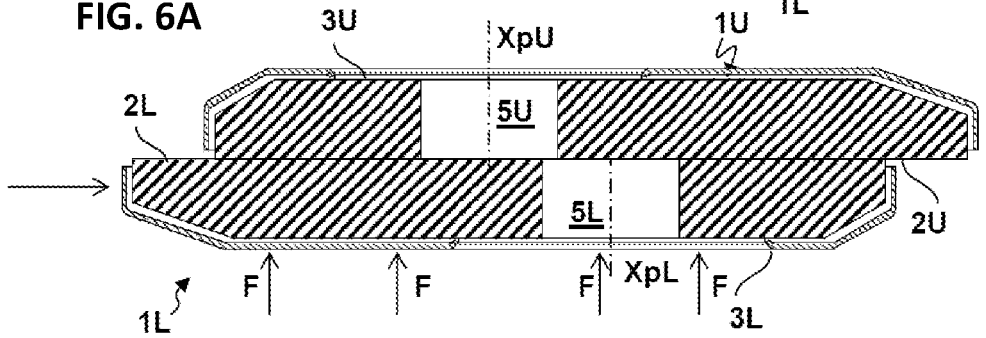
FIG. 6B is a longitudinal section of two plates positioned with their respective upper surfaces in sliding contact, with their respective pouring axes offset.
Figure 7A:
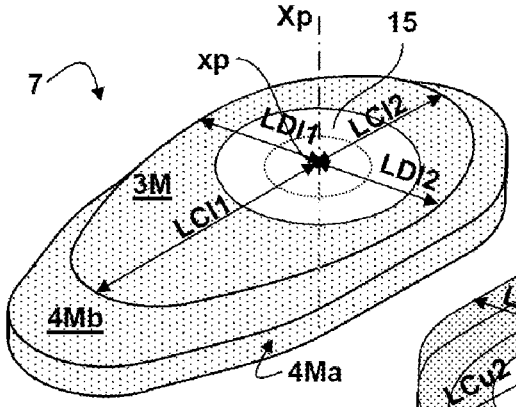
FIGS. 7A and 7B are three-dimensional isometric views of a metal can suitable for dressing a plate according to FIGS. 2 and 3.
Figure 7B:
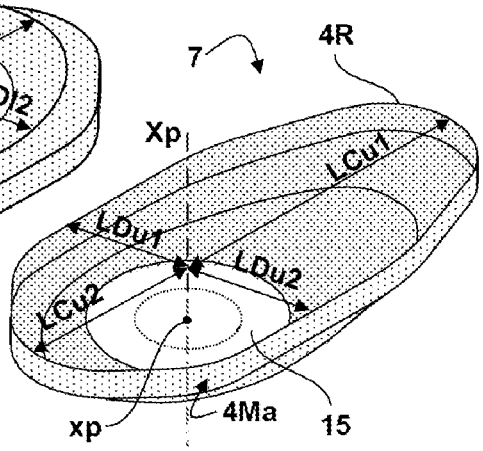

FIGS. 1 to 3 show a refractory sliding gate valve plate 1 for a molten metal gate valve having an upper surface 2 and a lower surface 3. Both the upper and lower surfaces are parallel as is usually the case in a sliding gate valve and they are separated from one another by a thickness of the sliding gate plate. In FIGS. 1 to 3, the sliding gate plate is depicted naked, i.e., without metal can or band surrounding or protecting the plate. In FIGS. 4 and 5, the latitudinal extents of canned sliding gate valve plates are depicted. In FIG. 6A and FIG. 6B, two identical canned plates according to the present invention are depicted in their respective position in use in a sliding gate valve: (a) in an open configuration, wherein the pouring channel of the first and second sliding gate valve plates are in registry, and (b) wherein they are almost out of fluid communication, thus reducing considerably the flow rate of pouring metal melt. Pusher units apply a force F onto the lower surface of the first sliding gate valve plate so that the upper surface thereof is pressed against the upper surface of the second sliding gate valve plate. In FIG. 7 a metal can is illustrated.

The upper and lower surfaces 2, 3 of a sliding gate valve plate are connected by a connecting outer surface 4. Also visible on the plate 1 is a pouring channel 5 fluidly connecting internally the upper surface 2 to the lower surface 3. The pouring axis of symmetry Xp of the pouring channel 5 is also depicted. The upper and lower longitudinal extents (LOu, LOl) of the upper and lower surfaces 2, 3 are also represented and, perpendicular to the upper and lower longitudinal extents (LOu, LOl), there are the upper and lower surfaces latitudinal extents (LAu, LAl). The upper and lower longitudinal extents (LOu, LOl) are divided into two segments (respectively LOu1 and LOu2 and LOl1 and LOl2) connecting at the level of the pouring axis of symmetry (Xp). Similarly, the upper and lower latitudinal extents (LAu, LAl) are divided into two segments (respectively LAu1 and LAu2 and LAl1 and LAl2) connecting at the level of the pouring axis of symmetry (Xp). The following ratios are defined R1=LOl1/LOu1, R2=LOl2/LOu2, R3=LAl1/LAu1 and R4=LAl2/LAu2. In the embodiment of FIGS. 1 to 3, R1 is about 80% (i.e. having a value from and including 65% to and including 90%), R2 is about 80% (i.e. having a value from and including 65% to and including 90%), R3=R4 is about 95% (i.e. greater than or equal to 90%).

FIGS. 4 and 5 show two embodiments of sliding gate valve plates according to the invention wherein the plates 1 are formed by the combination of a refractory body, mortar or cement 6 and a metal can 7 surrounding the periphery and a part of a lower surface of the refractory body. In FIGS. 4 and 5, R3 and R4 are equal as the plate has been formed symmetrically with respect to the longitudinal axis. In FIG. 4, R3 is equal to 100% and in FIG. 5, to about 95%. As visible on these figures, the lower surfaces of a sliding gate valve plate is are delimited by the outer boundary defining the perimeter of the planar surface of the metal can dressing the ceramic body.

FIG. 7 illustrates an embodiment of metal can for dressing a refractory body to form, in combination, a sliding gate valve plate according to the present invention. The metal can comprises a bottom surface (3M) which is planar and defined by a perimeter, and comprising an opening (15) having a centroid point (xp), such that the pouring axis of symmetry (Xp) is the axis normal to the plane of the bottom surface and passing through the centroid point (xp). The phantom circle represented in FIG. 7 with a dotted line within the opening (15) represents the position of the pouring channel (5) running through the refractory body, when the can dresses said refractory body. A peripheral surface (4Ma, 4Mb) extending transverse to the bottom surface from the perimeter of said bottom surface to a free end defining a rim (4R) of the metal can, thus forming with the bottom surface, a cavity of geometry fitting the geometry of a refractory element to be adhered to the metal can by means of a cement. The upper longitudinal diameter (LCu) is defined as the longest segment connecting two points of the rim of the metal can and intersecting the pouring axis of symmetry (Xp). The upper latitudinal diameter (LDu) connects two points of the rim of the metal can, and intersects perpendicularly the upper longitudinal diameter (LCu) and the pouring axis of symmetry (Xp).

The bottom surface (3M) has a lower longitudinal diameter (LCl), which is parallel to the upper longitudinal diameter (LCu) and has a lower latitudinal diameter (LDl), which is parallel to the lower longitudinal diameter (LDu), both lower longitudinal and latitudinal diameters intersect the pouring axis of symmetry at the centroid point (xp). The bottom surface of the metal can defines the lower surface of the sliding gate valve plate when coupled to a refractory body. The lengths of the longitudinal and latitudinal diameters are determined ignoring the opening (15).

The following ratios are defined

Rc1=LCl1/LCu1, has a value from and including 50% to and including 95%, or from and including 57% to and including 92%, or from and including 62.5 to and including 90%, Rc2=LCl2/LCu2, has a value from and including 50% to and including 95%, or from and including 57% to and including 92%, or from and including 62.5% to and including 90%, Rc3=LDl1/LDu1, is greater than or equal to 75%, or greater than or equal to 90%, or greater than or equal to 95%, Rc4=LDl2/LDu2, is greater than or equal to 75%, or greater than or equal to 90%, or greater than or equal to 95%.

As illustrated in FIG. 6A and FIG. 6B, in use a first sliding gate valve plate (1L) according to the present invention is mounted in a sliding gate valve frame with its upper surface (2L) parallel and in contact with an upper surface (2U) of a second sliding gate valve plate (1U) comprising a pouring channel (5U). The sliding gate valve frame comprises a static receiving station for holding the second valve plate (1U) in a fixed position; when the frame is mounted at the bottom of a metallurgical vessel comprising an outlet, such as a ladle, the second sliding gate plate is fixed in a position such that the pouring channel (5U) is in registry with the metallurgical vessel outlet.

Figure 8A:
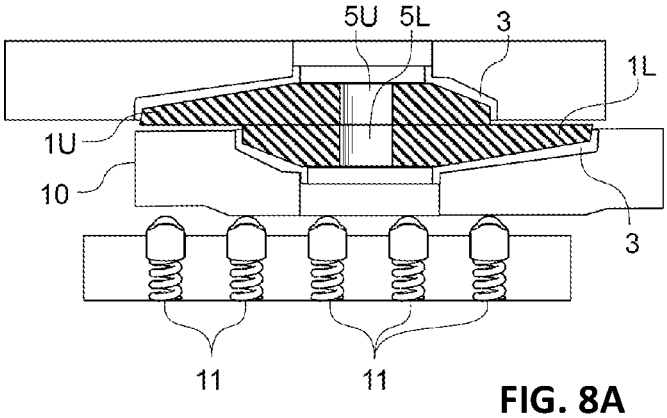
FIGS. 8A, 8B and 8C are projections on a horizontal plane, containing XpL and LOu, of an embodiment of a slide gate valve in communication with a pusher.

As illustrated in FIG. 8A, the frame also comprises a dynamic receiving station comprising a carriage (10) for holding the first sliding valve plate with the upper surface (2L) thereof facing parallel to, and contacting the upper surface (2U) of the second sliding valve gate plate in a sliding relationship. The dynamic receiving station further comprising several pusher units (11) oriented and distributed so as to apply a pushing force (F) onto a lower surface of the carriage, which is transmitted to the lower surface (3L) of the first sliding gate valve plate (1L) and is oriented normal to said lower surface (3L) of the first sliding gate valve plate, to press the upper surface of the first sliding gate valve plate against the upper surface of the second sliding gate valve plate. The distribution of pusher units over the lower surface of the carriage and of the first sliding gate valve plate has been identified as being critical to the effective contact area achieved between the upper surfaces of the first and second sliding gate valve plates. With a geometry of the first sliding gate valve plate with the ratios R1 to R4 as defined supra, it has been surprisingly observed that the effective contact area could be enhanced and the mechanical stress peaks measured on the plate could be substantially reduced compared with a prior art sliding gate valve plate (cf. Tables 1 to III below).

The frame comprises a sliding mechanism for moving the carriage holding the first sliding gate valve plate (1L) with respect to the second sliding gate valve plate (1U) by sliding the upper surface (2L) of the first sliding gate valve plate (1L) over the upper surface (2U) of the second sliding gate valve plate (1U), from a pouring position wherein the pouring channel (5U) of the first sliding valve gate plate (1U) is in registry with the pouring channel (5L) of the second sliding valve gate plate (1L), to a closed position, wherein the pouring channel of the first sliding valve gate plate (1U) is not in fluid communication with the pouring channel of the second sliding valve gate plate (1L).

The sliding mechanism may be an electric, pneumatic or hydraulic arm fixed at one end of the connecting outer surface (4) of a sliding gate valve plate (1L), and able to push, pull, or rotate the first sliding gate valve plate over the upper surface (2U) of the second, static, slide gate valve plate (1U).

The sliding gate is formed by mounting a first sliding gate valve plate in the carriage of the dynamic receiving station, and a second sliding gate valve plate in the static receiving station. The ratio, AL/AU, of an area, AL, of the lower surface of the first sliding plate to an area, AU, of the upper surface of the first sliding plate is the ratio, has a value from and including 40% to and including 85%. The first sliding gate valve plate may be configured according to the present invention. The second sliding gate valve plate may also be configured according to the present invention. The second sliding gate valve plate can be similar or even identical to the first sliding gate valve plate.

The sliding gate valve is designed so that the thrust force communicated by the sliding gate valve to a sliding gate valve plate used in that sliding gate valve is concentrated around the pouring orifice. More than 55%, or more than 60% of the surface of the plate (thus the lower surface) receiving the thrust force may be located at a distance from the pouring axis of symmetry Xp less than or equal to LaL1. With the plate illustrated in FIG. 1, 63% of the surface of the plate (thus the lower surface) receiving the thrust force is located at a distance from the pouring axis of symmetry Xp less than or equal to Lal1.

A carriage (10) for holding a first plate in a dynamic receiving station comprises a lower surface and an upper surface. The upper surface is preferably parallel to and recessed from the upper surface of a first sliding gate valve plate mounted therein. As the carriage moves parallel to and relative to the upper surfaces of the second sliding gate valve plate, it also moves relative to the pusher units (11). In state of the art carriages, the pusher units are constantly in contact with the lower surface of the carriage irrespective of the position of the carriage relative to the pusher units. Because the upper surface of the carriage is recessed with respect to the upper surface of the first sliding gate valve plate, in case the carriage is in a position in which the first sliding gate valve plate does not face a pusher unit; the force of said pusher unit will apply a flexural stress in cantilever onto the dynamic receiving station. This creates stress concentrations at the edges of the sliding gate valve plates, which accelerates wear. It also releases the pressure around the pouring channel and thus reduces the tightness of the sliding gate valve.

It has been found that this problem can be solved by designing the bottom surface of the carriage such that at all time it is in contact with at least one pusher unit, and such that a pusher unit contacts the lower surface of the carriage only in case the projection on a longitudinal plane (XpL, LOu) defined by the pouring axis of symmetry (XpL) and the upper longitudinal extent (LOu) of the first sliding valve plate (1L) of the force vector defining the force (F) applied by said pusher unit when in contact with the lower surface intersects the projection on said longitudinal plane of the first sliding gate valve plate. In certain configurations, the application of a force by a pusher unit onto the lower surface of the carriage requires the projection of the force vector on the longitudinal plane to intersect the projection on the longitudinal plane of the second sliding gate valve plate as well. Since both the pusher units and the second sliding gate valve plate are static in the sliding gate valve, the fulfillment of this conditions is independent of the position of the first sliding gate valve plate relative to the pusher units.

A projected force vector is considered to intersect a projected sliding gate valve plate if said projected force vector either actually crosses the projected sliding gate valve plate, or falls within a tolerance of half the width of the pusher unit measured along the longitudinal plane. For example, if the pusher units comprise helicoidal springs, the tolerance would be half the diameter of the last coil, closest to the carriage, of said helicoidal springs. In certain configurations, the tolerance is within 20 mm, or within 10 mm from having an actual intersection between the projected force vector and the projected sliding gate valve plate.

Figure 8B:
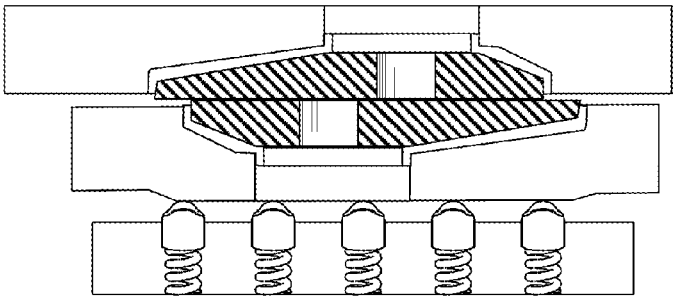
Figure 8C:
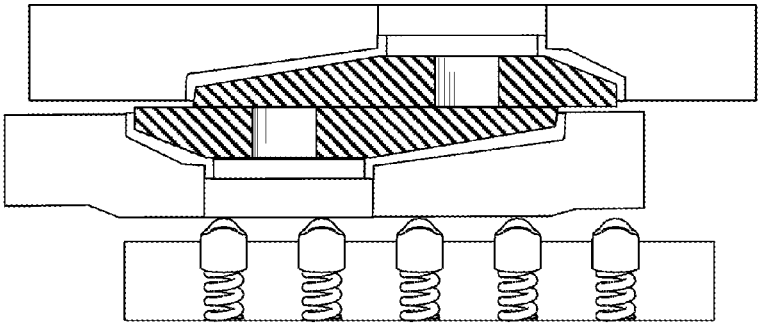

As illustrated in the cut views along the longitudinal plane of FIG. 8, said geometry may comprise chamfered portions. It can be seen that the sliding gate valve of FIG. 8 is designed such that the pusher units face the second sliding gate valve plate. Because both are static, this situation is maintained regardless of the position of the first sliding gate valve plate. In FIG. 8(*a*), the first sliding gate valve plate is in pouring position, with the upper and lower pouring channels forming a single, continuous channel. It can be seen that of the five pusher units (11) represented, only four of them face the first sliding gate valve plate (1L). These four pusher units in contact are also in contact with the lower surface of the carriage and apply thereon a vertical force, transmitted to the first sliding gate valve plate. The fifth pusher unit on the left-hand side of FIG. 8(*a*) does not face the first sliding gate valve plate and is also not in contact with (or does not apply a substantial force to) the lower surface of the carriage, which is chamfered at said portion. This way, the fifth pusher unit does not apply a bending force onto the carriage, which would tend to reduce the distance between the upper surfaces of the carriage and of the second sliding gate valve plate.

In FIG. 8(*b*), the sliding gate valve is in a first closed position, wherein the upper and lower pouring channels are not in fluid communication, but are separated from one another by a short distance only. The tightness of the sliding gate valve therefore depends on a maximum compressive force concentrated around the upper and lower pouring channels, respectively. In this position, all five pusher units represented in FIG. 8(*b*) are in contact with the lower surface of the carriage applying a high compressive pressure concentrated around the pouring channels.

In FIG. 8(*c*), the sliding gate channel is in closed position, with a large distance separating the upper and lower pouring channels. The pusher unit represented on the right-hand side of FIG. 8(*c*) does not face the first sliding gate valve plate, and does not contact (or does not apply a substantial force to the lower surface of the carriage, which is chamfered at said portion. This way, as discussed in reference with FIG. 8(*a*), the right-hand side pusher unit does not apply a bending force onto the carriage, which would tend to reduce the distance between the upper surfaces of the carriage and of the second sliding gate valve plate.

A carriage (10) as discussed supra in reference with FIG. 8 is advantageous in use with any type of sliding gate valve plates, as it extends the service life of the sliding gate valve plates. It is also advantageous with a first sliding gate valve plate according to the present invention and also advantageous with a second sliding gate valve plate according to the present invention, as the forces applied by the pusher units in contact with the lower surface of the carriage are more homogeneously distributed over a larger area of the upper surfaces of the first and second sliding gate valve plates, said area extending around the pouring channel. This better distribution of the pressure over a larger area has two advantages. First, it prevents pressure peaks which are detrimental to the integrity of the sliding gate valve plates, thus extending their service life. Second, it prevents areas of lower pressures, inevitable when pressure peaks are present, thus increasing the tightness of the sliding gate valve. This is important to reduce both oxygen ingress and molten metal ingress between the first and second sliding gate valve plates.

In order to demonstrate the effects of the invention, the inventors have performed a number of finite element analysis computations of the actual and theoretical contact areas of two sliding gate valve plates mounted in a sliding gate valve. These computations do not take into account the effect of heat. In a first series, a sliding gate valve corresponding to U.S. Pat. No. 6,814,268 B2 was designed. This model comprises a base plate, a carrier plate, a door, two refractory sliding gate valve plates and a ladle bottom. A thrust force is applied on the plates by a plurality of springs in order to keep the plates in compression and increase the contact area between the two plates. A first output of the computations is the maximum contact pressure (MPa) that is the highest peak of pressure at the contact surface between the refractory sliding gate valve plates. The effective contact area is the ratio (in %) of the actual contact area (ignoring any hole in the periphery) between the sliding gate valve plates as computed by finite element analysis to the theoretical contact area (assuming that the contact is perfect), when the pouring channels of both plates are perfectly in registry. For example, if the sliding gate valve plates theoretical contact area is equal to 1000 $mm^2$ and the computed actual contact area is 250 $mm^2$. The effective contact area (%) is then 250/1000=0.25=25%. The computation was made with the plate described in U.S. Pat. No. 6,814,268 B2 (prior art: wherein R1=R2=R3=R4=100%; for the sake of comparison) and with plates according to the invention. The results are reported in tables I to III below. In these example, R4 was kept equal to R3. The observed (and calculated) deviations between the actual and theoretical contact areas are due to, on the one hand, the mechanical stresses applied by the molten metal flowing through the pouring channel and, on the other hand, the substantial thermal gradients created over the volumes of the sliding gate valve plates.

TABLE I (effect of R3 (= R4))

| Examples | Prior Art | 1 | 2 | 3 | 4 |
|---|---|---|---|---|---|
| R1 | 100% | 80% | 80% | 80% | 80% |
| R2 | 100% | 80% | 80% | 80% | 80% |
| R3 | 100% | 95% | 97% | 99% | 100% |
| Effective contact area (%) | 38.4 | 68.3 | 64.5 | 61.7 | 60.1 |
| Maximum Contact pressure (MPa) | 12.8 | 6.1 | 6.7 | 7.2 | 7.6 |

As can be seen in table I, with plates according to the invention, the effective contact area is raised from 38.4% for a plate of the prior art to up to 68.3% (example 1). At the same time, the maximum contact pressure is lowered from 12.8 MPa to 6.1 MPa. Keeping R1 and R2 constant, increasing R3 (and R4) from 95% to 100% has a very slightly negative effect on the effective contact area (decreasing from 68.3% to 60.1%) and on the maximum contact pressure (increasing from 6.1 to 7.6 MPa). All the measured values are still acceptable and far better than what can be observed with the prior art plate.

TABLE II (effect of R2)

| Examples | Prior Art | 5 | 6 | 7 | 8 |
|---|---|---|---|---|---|
| R1 | 100% | 80% | 80% | 80% | 80% |
| R2 | 100% | 90% | 90% | 90% | 90% |
| R3 | 100% | 95% | 97% | 99% | 100% |
| Effective contact area (%) | 38.4 | 60.9 | 57.1 | 53.9 | 52.2 |
| Maximum Contact pressure (MPa) | 12.8 | 7.1 | 7.7 | 8.2 | 8.8 |

Table II is based on examples similar to table I with R2 changed to 90% (instead of 80% in table I). The same trends can be observed for the effect of R3 (and R4). Moreover, it can be observed that raising R2 from 80% to 90% has a negative effect both on the effective contact area and the maximum contact pressure (conclusion can be made by comparing the pairs of examples 1-5, 2-6, 3-7, 4-8). Therefore, according to the invention, R2 should not go beyond 90%.

TABLE III (effect of R1)

| Examples | Prior Art | 9 | 10 | 11 | 12 |
|---|---|---|---|---|---|
| R1 | 100% | 90% | 90% | 90% | 90% |
| R2 | 100% | 80% | 80% | 80% | 80% |
| R3 | 100% | 95% | 97% | 99% | 100% |
| Effective contact area (%) | 38.4 | 67.3 | 64.2 | 60.7 | 59.1 |
| Maximum Contact pressure (MPa) | 12.8 | 6.8 | 6.9 | 7.7 | 7.9 |

Table III is based on examples similar to table I with R1 changed to 90% (instead of 80% in table I). The same trends can be observed for the effect of R3 (and R4). Moreover, it can be observed that raising R1 from 80% to 90% has a negative effect both on the effective contact area and the maximum contact pressure (conclusion can be made by comparing the pairs of examples 1-9, 2-10, 3-11, 4-12). Therefore, according to the invention, R1 should not go beyond 90%.

In a second series of finite element analysis computation, in order to mimic a thermal shock, a boundary condition simulating the heat flux transmitted by molten steel flowing through the pouring channel of the plate is applied to the system at the level of the wall of the pouring channel. The same analysis is performed on the prior art plate mentioned above, on a naked refractory sliding gate valve plate according to the invention (R1=R2=80%, R3=R4=95%), on an isolated canned plate (i.e. the combination of a refractory plate, mortar or cement and a metal envelope surrounding the periphery and a part of a surface; R1=R2=80%, R3=R4=95%) and on a canned plate in a sliding gate valve (same plate). The comparison between these models permits quantifying the thermal stress as well as the thermo-mechanical stress. The computation has been repeated for a number of examples wherein the connecting outer surface is varying. These finite element analysis computations confirm the trend observed within the first series.

Various features and characteristics of the invention are described in this specification and illustrated in the drawings to provide an overall understanding of the invention. It is understood that the various features and characteristics described in this specification and illustrated in the drawings can be combined in any operable manner regardless of whether such features and characteristics are expressly described or illustrated in combination in this specification. The Inventor and the Applicant expressly intend such combinations of features and characteristics to be included within the scope of this specification, and further intend the claiming of such combinations of features and characteristics to not add new matter to the application. As such, the claims can be amended to recite, in any combination, any features and characteristics expressly or inherently described in, or otherwise expressly or inherently supported by, this specification. Furthermore, the Applicant reserves the right to amend the claims to affirmatively disclaim features and characteristics that may be present in the prior art, even if those features and characteristics are not expressly described in this specification. Therefore, any such amendments will not add new matter to the specification or claims, and will comply with the written description requirement under 35 U.S.C. § 112(a). The invention described in this specification can comprise, consist of, or consist essentially of the various features and characteristics described in this specification.

The invention claimed is:

1. Sliding gate valve plate for a molten metal gate valve having an upper surface, a lower surface, separated from the upper surface by a thickness of the sliding gate valve plate, said upper and lower surfaces being planar and parallel to one another, a connecting outer surface connecting the upper surface to the lower surface and a pouring channel fluidly connecting the upper surface to the lower surface, said pouring channel having a pouring axis of symmetry (Xp), the upper and lower surfaces having upper and lower longitudinal extents (LOu, LOl), respectively, which are parallel to each other and perpendicular to upper and lower latitudinal extents (LAu, LAl), respectively, wherein the upper longitudinal extent (LOu) is the longest segment connecting two points of a perimeter of the upper surface and intersecting the pouring axis of symmetry (Xp), wherein the longitudinal extents (LOu, LOl) are divided into two segments (respectively LOu1 and LOu2 and LOl1 and LOl2) connecting at the level of the pouring axis of symmetry (Xp), and wherein the segments LOu1 and LOl1 are on a first side of the pouring axis of symmetry, and the segments LOu2 and LOl2 are on a second side of the pouring axis of symmetry;

wherein the latitudinal extents (LAu, LAl) are divided into two segments (respectively LAu1 and LAu2 and LAl1 and LAl2) connecting at the level of the pouring axis of symmetry (Xp), and wherein the segments LAu1 and LAl1 are on a first side of the pouring axis of symmetry, and the segments LAu2 and LAl2 are on a second side of the pouring axis of symmetry;

wherein the following ratios are defined,

LOl1/LOu1=R1,

LOl2/LOu2=R2,

LAl1/LAu1=R3,

LAl2/LAu2=R4, wherein R1 has a value from and including 50% to and including 95%, wherein R2 has a value from and including 50% to and including 95%, wherein R3 is greater than or equal to 75%, and wherein R4 is greater than or equal to 75%.

2. Sliding gate valve plate according to claim 1 wherein R3=R4.

3. Sliding gate valve plate according to claim 1 wherein the connecting outer surface comprises a plurality of surface portions.

4. Sliding gate valve plate according to claim 3 wherein the connecting outer surface comprises at least a cylindrical surface portion and at least one transition surface portion.

5. Sliding gate valve plate according to claim 4 wherein the cylindrical surface portion connects the upper surface to an adjacent transition surface portion and the at least one transition surface portion connects the cylindrical surface portion to the lower surface.

6. Sliding gate valve plate according to claim 3, wherein the connecting outer surface comprises a plurality of transition surface portions.

7. Sliding gate valve plate according to claim 1, wherein R1 and R2 have values from and including 75% to and including 85%.

8. Sliding gate valve plate according to claim 1, wherein R3 and R4 have values from and including 98% to and including 100%.

9. Sliding gate valve plate according to claim 1, wherein the plate comprises:

a refractory element with an upper surface and a pouring channel corresponding respectively to the upper surface and pouring channel of the plate, a metal can with a bottom surface corresponding to the lower surface of the sliding gate valve plate, said bottom surface comprising an opening surrounding the pouring channel of the sliding gate valve plate, cement binding the refractory element to the metal can.

10. A metal can for dressing a refractory element and therewith forming a sliding gate valve plate according to claim 9, said metal can comprising:

a bottom surface which is planar and defined by a perimeter, and comprising an opening having a centroid point (xp), such that the pouring axis of symmetry (Xp) is the axis normal to the bottom surface and passing through the centroid point (xp);

a peripheral surface extending transverse to the bottom surface from the perimeter of said bottom surface to a free end defining a rim of the metal can, said peripheral surface and bottom surface defining an inner cavity of geometry fitting the geometry of a refractory element to be adhered to the metal can by means of a cement, and wherein:

the metal can has an upper longitudinal diameter (LCu) defined as the longest segment, connecting two points of the rim of the metal can and intersecting the pouring axis of symmetry (Xp), and has an upper latitudinal diameter (LDu) connecting two points of the rim of the metal can, and intersecting perpendicularly the upper longitudinal diameter (LCu) and the pouring axis of symmetry (Xp), the bottom surface (3M) has a lower longitudinal diameter (LCl), which is parallel to the upper longitudinal diameter (LCu) and has a lower latitudinal diameter (LDl), which is parallel to the lower longitudinal diameter (LDu), both lower longitudinal and latitudinal diameters intersecting the pouring axis of symmetry at the centroid point (xp);

the upper and lower longitudinal diameters (LCu, LCl) being divided into two segments (respectively LCu1 and LCu2 and LCl1 and LCl2) connecting at the level of the pouring axis (Xp), and wherein the segments LCu1 and LCl1 are on a first side of the pouring axis of symmetry, and the segments LOu2 and LOl2 are on a second side of the pouring axis of symmetry;

the upper and lower latitudinal diameters (LDu, LDl) being divided into two segments (respectively LDu1 and LDu2 and LDl1 and LDl2) connecting at the level of the pouring axis of symmetry (Xp), and wherein the segments LAu1 and LAl1 are on a first side of the pouring axis of symmetry, and the segments LDu2 and LDl2 are on a second side of the pouring axis of symmetry;

wherein the following ratios are defined:

Rc1=LCl1/LCu1, and has a value from and including 50% to and including 95%, Rc2=LCl2/LCu2, and has a value from and including 50% to and including 95%, Rc3=LDl1/LDu1, is greater than or equal to 75%, Rc4=LDl2/LDu2, is greater than or equal to 75%.

11. Sliding gate valve comprising a set of a first sliding gate valve plate according to claim 1 and a second sliding gate valve plate, wherein, the second sliding gate valve plate comprises a planar upper surface which is planar and has an upper area, AU, delimited by a perimeter enclosing an outlet of a pouring channel and of same geometry as the upper surface of the first sliding gate valve plate, and comprises a lower surface, which is planar and is delimited by a perimeter enclosing an inlet of the pouring channel, the planar upper and lower surfaces of the second sliding gate valve plate being parallel with one another, wherein said first and second sliding valve gate plates are mounted in a frame with their respective upper surfaces contacting and parallel to each other such that, the second sliding gate valve plate is fixedly mounted in the frame, the first sliding gate valve plate can reversibly move along a plane parallel to the upper surfaces of the first and second sliding valve plates from a pouring position wherein the pouring channel of the first sliding valve gate plate is in registry with the pouring channel of the second sliding valve gate plate, to a closed position, wherein the pouring channel of the first sliding valve gate plate is not in fluid communication with the pouring channel of the second sliding valve gate plate, said sliding gate valve further comprising several pusher units distributed about, and applying a pushing force onto the lower surface of the first sliding gate valve plate oriented normal to said lower surface of the first sliding gate valve plate, to press the upper surface of the first sliding gate valve plate against the upper surface of the second sliding gate valve plate.

12. Sliding gate valve according to claim 11, comprising a second sliding valve plate according to claim 1.

13. Sliding gate valve according to claim 11, wherein:

the first sliding gate valve plate is supported by a carriage mounted on a sliding mechanism, such that the upper surface of the first sliding gate valve plate can slide between the pouring position and the closed position, said carriage comprising a lower surface, the pusher units apply a pushing force (F) onto the lower surface of the carriage, such as to press the upper surface of the first sliding gate valve plate against the upper surface of the second sliding gate valve plate, wherein said force (F) is oriented normal to the lower surface of the carriage.

14. Sliding gate valve according to claim 13, wherein (a) the carriage comprises an upper surface parallel to and recessed from the upper surface of the first sliding gate valve plate, (b) the pusher units are static and face the second sliding gate valve plate regardless of the position of the first sliding gate valve plate, (c) the lower surface of the carriage is permanently in contact with at least some of the pusher units, and has a geometry comprising chamfered portions, such that a pusher unit contacts the lower surface of the carriage only in case the projection on a longitudinal plane (XpL, LOu) defined by the pouring axis of the symmetry (XpL) and the upper longitudinal extent (LOu) of the first sliding valve plate of the force vector defining the force (F) applied by said pusher unit when in contact with the lower surface intersects the projection on said longitudinal plane of the first sliding gate valve plate.

15. Sliding gate valve according to claim 14, wherein when a pusher unit does not face the first sliding gate valve plate, it does not contact the lower surface of the carriage, which is chamfered at said portion.

* * * * *